US010928160B1

(12) United States Patent
Becklin et al.

(10) Patent No.: US 10,928,160 B1
(45) Date of Patent: Feb. 23, 2021

(54) HANDGUARD ENDCAP

(71) Applicant: ERA3 LLC, Merlin, OR (US)

(72) Inventors: Dennis Sterling Becklin, Grants Pass, OR (US); Jason Hulst, Grants Pass, OR (US)

(73) Assignee: ERA3 LLC, Merlin, OR (US)

( * ) Notice: Subject to any disclaimer, the term of this patent is extended or adjusted under 35 U.S.C. 154(b) by 0 days.

(21) Appl. No.: 16/732,264

(22) Filed: Dec. 31, 2019

(51) Int. Cl.
*F41C 23/16* (2006.01)
*F41A 3/66* (2006.01)

(52) U.S. Cl.
CPC ..... *F41C 23/16* (2013.01); *F41A 3/66* (2013.01)

(58) Field of Classification Search
CPC ..... F41C 23/16
USPC ..... 42/71.01
See application file for complete search history.

(56) References Cited

U.S. PATENT DOCUMENTS 6,792,711 B2 9/2004 Battaglia
8,336,243 B2 12/2012 Langevin et al.

OTHER PUBLICATIONS

"Custom Free Float End Cap" discussion beginning Nov. 20, 2013, from AR15Forums.com, retrieved from the Internet at https://www.ar15forums.com/threads/custom-free-float-end-cap.13393/ on Dec. 26, 2019, 3 pages.
"End Cap for AR-15 Free Float Quad Rail/KeyMod Handguards" advertisement dated 2019 from Monstrum, retrieved from the Internet at https://monstrumtactical.com/ar-15-quad-rail-handguard-free-float-circular-end-cap/ on Dec. 26, 2019, 3 pages.
"Tacfire 8 Angled AR-15 Carbon Fiber KeyMod Free Float Handguard," dated 2019 from TacticalStore, retrieved from the Internet at https://www.tactical-store.com/ts-29u-hz-cfkm.html on Dec. 26, 2019, 3 pages.
"TirRock 15" inch .308/7.62 Keymod Handguard Free Float advertisement dated 2019 from Project Four Seasons, retrieved from the Internet at https://projectfourseasons.com/products/tirrock-15-inch-308-7-62-keymod-handguard-free-float on Dec. 26, 2019, 2 pages.
"Yankee Hill Machine Co., Inc.—AR-15 15/16" Forearm End Cap Aluminum Black advertisement dated 2019 from Brownells, retrieved from the Internet at https://www.brownells.com/rifle-parts/forend-amp-handguard-parts/handguard-amp-rail-hardware/handguard-caps/ar-15-15-16-forearm-end-cap-aluminum-black-prod25015.aspx on Dec. 26, 2019, 2 pages.

*Primary Examiner* — Reginald S Tillman, Jr.
(74) *Attorney, Agent, or Firm* — Lowe Graham Jones PLLC

(57) ABSTRACT

A handguard comprising a tube centered on a central axis and a rail protruding outwardly from the tube and extending along the tube parallel to the central axis. An endcap is secured to a face of the tube and includes a ring portion extending around a face of the tube and a rail cap extending outwardly from the ring portion and covering a face of the rail. Splines protruding inwardly within the tube and the endcap includes tabs positioned between pairs of adjacent splines of the plurality of splines. Fasteners pass through the tube and engage the tabs. The ring portion may increase with thickness from the rail cap. The front of the rail cap may include two regions with different slopes.

13 Claims, 4 Drawing Sheets

HANDGUARD ENDCAP

FIELD OF THE INVENTION

This invention relates to rifles and, more particularly, to handguards for rifles.

BACKGROUND OF THE INVENTION

The AR10 and AR15 are very popular firearm platforms. There are many interchangeable, aftermarket components available making the platform very versatile. The standardization of the system is convenient for interchangeability. It would be an advancement in the art to improve the functionality and versatility of the AR10 and AR15 firearm platforms.

SUMMARY OF THE INVENTION

In one aspect of the invention, an apparatus includes a handguard comprising a tube centered on a central axis and a rail protruding outwardly from the tube and extending along the tube parallel to the central axis. An endcap is secured to a face of the tube and includes a ring portion extending around a face of the tube and a rail cap extending outwardly from the ring portion and covering a face of the rail.

In some embodiments, the handguard further includes a plurality of splines protruding inwardly within the tube and extending parallel to the central axis. The endcap may include one or more tabs, each tab of the one or more tabs positioned between a pair of adjacent splines of the plurality of splines. The tube may include a plurality of facets conforming to an octagonal shape, each spline of the plurality of splines being positioned at a junction of a pair of adjacent facets of the plurality of facets. The apparatus may include one or more fasteners, each fastener of the one or more fasteners extending through the tube and engaging one tab of the one or more tabs.

In some embodiments, the face of the tube is at a non-perpendicular angle with respect to the central axis, the ring portion increasing in thickness with distance from the rail cap. In some embodiments, the ring portion has a front ring face and a rear ring face opposite the front ring face, the rear ring face interfacing with the face of the tube and the front ring face being perpendicular to the central axis. The rail cap may have a front cap face and a rear cap face, the rear cap face interfacing with the face of the rail and the front cap face sloping toward the rail with distance from the ring portion.

In some embodiments, the rail has pointed sides and the rail cap has corresponding pointed sides, the front cap face extending from the ring portion to the pointed sides of the rail cap, the rail cap including a second cap face extending from the front cap face and sloping toward the rail with distance from the front cap face at a greater angle than the front cap face.

In some embodiments, the apparatus includes a rifle including an upper receiver and a barrel secured to the upper receiver, the tube being mounted to the upper receiver having the barrel positioned within the tube. In some embodiments, the barrel does not contact the tube.

In some embodiments, inner and outer surfaces of the ring portion are flush with inner and outer surfaces of the tube extending parallel to the central axis. In some embodiments, the tube is made of extruded metal. In some embodiments, the handguard includes a plurality of vent openings defined by the tube and distribute along the central axis.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
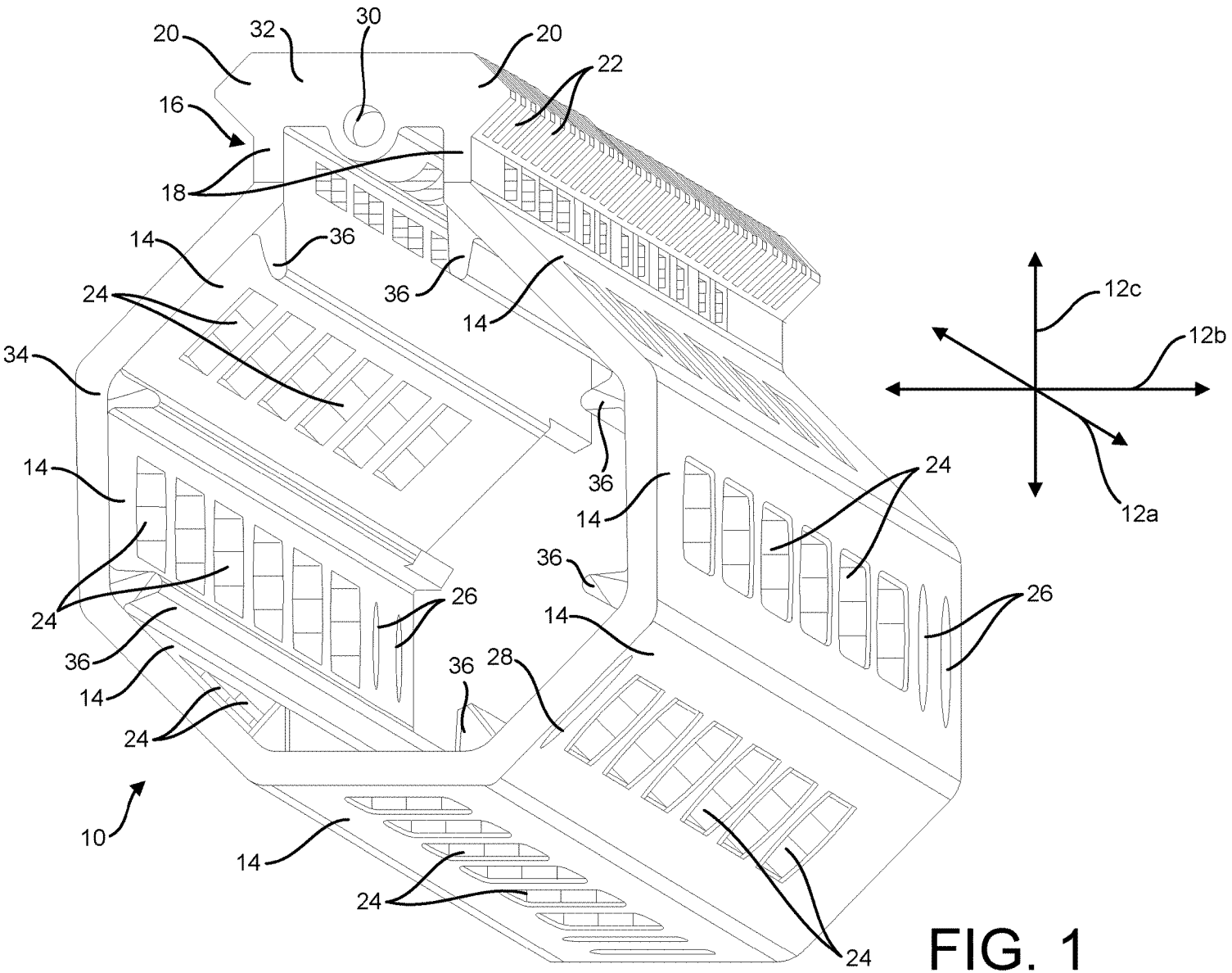
FIG. 1 is an isometric view of a handguard of a rifle suitable for use in accordance with an embodiment of the present invention.
Figure 2:
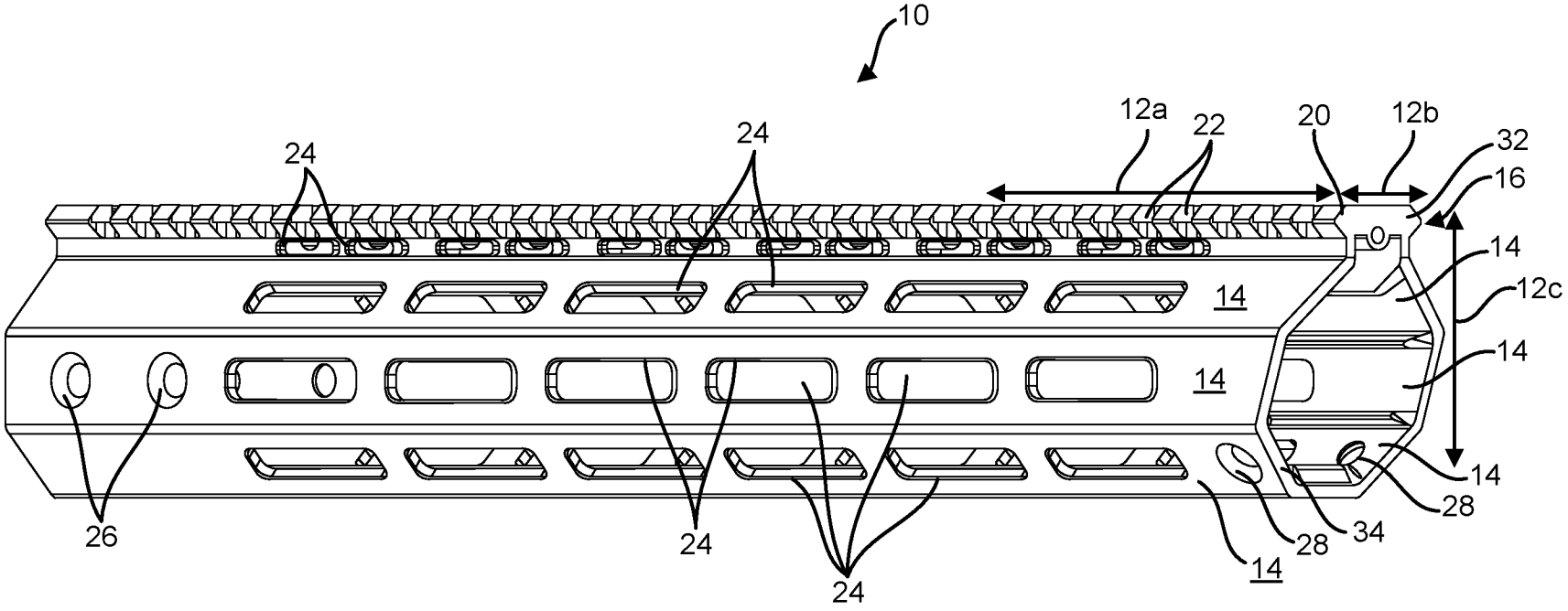
FIG. 2 is a side isometric view of the handguard of FIG. 1.

Referring to FIGS. 1, and 2, a handguard 10 for a rifle, such as an AR-15, may be as illustrated. The handguard 10 may be understood with respect to a longitudinal direction, 12*a*, horizontal direction 12*b*, and a vertical direction 12*c* that are all perpendicular to one another. The longitudinal direction 12*a* may correspond to the center of the barrel of the rifle to which the handguard 10 is mounted. In the illustrated embodiment, the handguard 10 has an extruded shape having a constant cross section along the longitudinal direction 12*a*, the extruded shape being machined with additional features as described below. The handguard 10 may be made of steel, aluminum, or other material.

In the illustrated embodiment, the handguard 10 has a generally octagonal shape with seven facets 14 confirming to an octagon and an eight side of the octagon being occupied by a rail 16 for mounting accessories, such as a Picatinny rail, Weaver rail, or other standard rail. As is apparent, the rail has a dovetail shape with a narrow upwardly protruding base 18 and pointed ridges 20 that extends outwardly from the top of the base in the horizontal direction 12*b*. The ridges 20 may have notches 22 machined along their lengths in the longitudinal direction 12*a* to facilitate fixing accessories into place.

Other features that may be formed in the handguard 10 may include openings 24 along each facet 14 and possibly in sides of the base 18 to facilitate cooling. Openings 26 at a rearward end of the handguard 10 may receive fasteners for securing the handguard 10 to the upper receiver (not shown) of a rifle in a conventional manner. One or more openings 28 may be formed at the forward end of the handguard 10 for securing an endcap as described below. In the illustrated embodiment, the rail 16 includes an opening 30 extending along the longitudinal direction 12*a* into the base 18, which may receive a fastener or pin that also engages the endcap as described below.

In the illustrated embodiment, a front face 32 of the rail 16 is planar and parallel to a horizontal-vertical plane parallel the horizontal and vertical directions 12*b*, 12*c*. In contrast, the front face 34 of a tube formed by the facets 14 of the handguard 10 are cut at an angle relative to the horizontal-vertical plane. In the illustrated embodiment, the face 34 slopes rearwardly with distance from the rail 16. In other embodiments, the face 34 of the tube is parallel to the horizontal-vertical plane and flush with the front face 32 of the rail 16.

In some embodiments, splines 36 extend along the interior of the tube parallel to the longitudinal direction 12*a*. In the illustrated embodiment, the splines 36 are tapered in the horizontal-vertical plane and each protrude inwardly from corners of the octagon formed at junction of adjacent facets 14 and at the junctions between two of the facets 14 and the base 18 of the rail 16.

Figure 3:
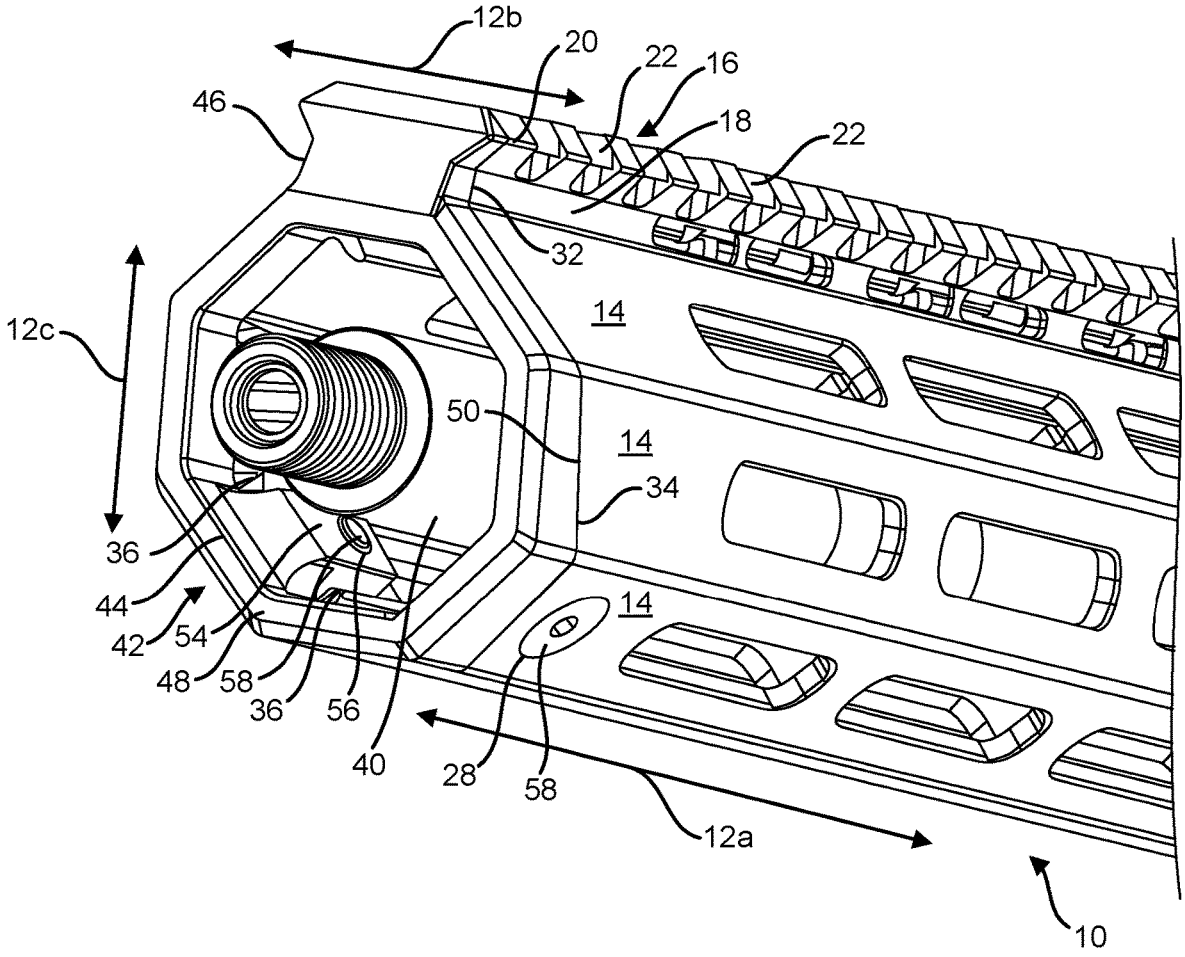
FIG. 3 is an isometric view of a handguard having an endcap mounted thereto in accordance with an embodiment of the present invention.

FIG. 3 illustrates the handguard 10 mounted around the barrel 40 of a rifle. As is apparent, the handguard 10 does not contact the barrel thereby providing a degree of thermal isolation from the barrel 40 that may become hot during use.

Figure 4:
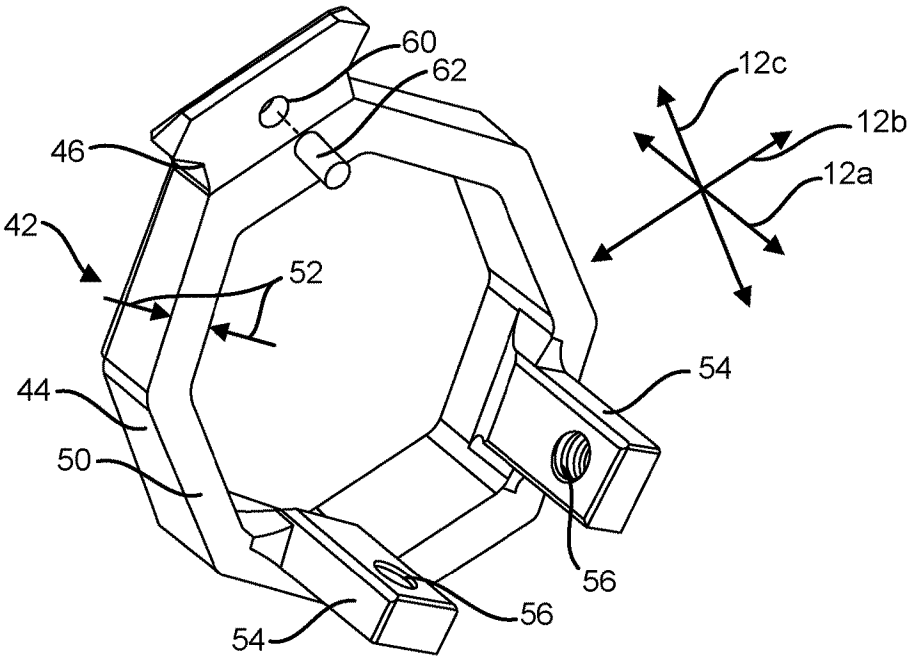
FIG. 4 is a rear isometric view of the endcap of FIG. 3.
Figure 5:
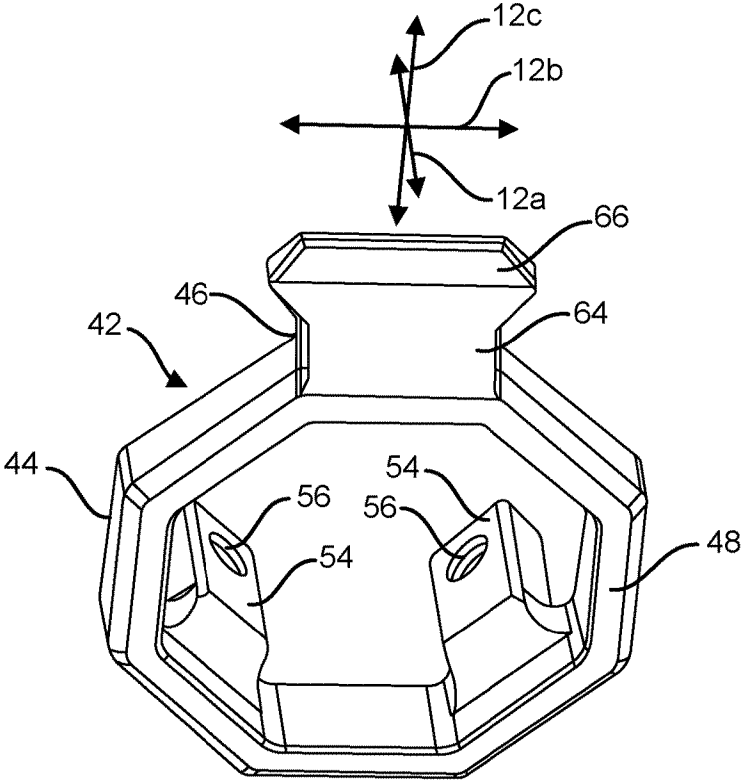
FIG. 5 is a front isometric view of the endcap of FIG. 3.

FIGS. 3, 4 and 5 further illustrate an endcap 42 secured over the front faces 32, 34 of the handguard 10. The endcap 42 may include a ring portion 44 that covers front edges of the tube formed by the facets 14, i.e. the front edges of the facets 14. The endcap 42 may include a rail cap 46 that secures to the ring portion 44 and extends over the face 32 of the rail 16. As is apparent, the rail cap 46 may match the shape of the rail 16 in the horizontal-vertical plane, including a base portion and pointed portions protruding outwardly form the base portion corresponding to the base 18 and ridges 20 of the rail 16.

As noted above, the face 34 of the tube formed by the facets 14 may be angled relative to the horizontal-vertical plane. In some embodiments, a front face 48 of the ring portion 44 is parallel to the horizontal-vertical plane whereas the rear face 50 that interfaces with face 34 may match the angle of the face 34 relative to the horizontal-vertical plane. Accordingly, the ring portion 44 is wedge-shaped due to this difference in angle and increases in depth in the longitudinal direction 12*a* with distance from the rail cap 46.

The thickness 52 of the ring portion 44 may match that of the handguard 10 such that inner surfaces of the ring portion 44 parallel to the longitudinal direction 12*a* are substantially flush with inner surfaces of the facets 14 and outer surfaces of the ring portion 44 parallel to the longitudinal direction 12*a* are substantially flush with outer surfaces of the facets 14 (e.g., within 0.5 mm of flush when installed).

One or more tabs 54 secure to inner surface of the ring portion 44 and protrude rearwardly from the ring portion 44. The tabs 54 extend between the splines 36 on either side of two of the facets 14. Faces of the tabs 54 facing the facets 14 may be parallel to these facets 14, i.e. conform to the angle and position of different legs of the same octagonal shape. In the illustrated embodiment, the tabs 54 extend over the facets 14 on either side of the facet directly opposite the rail 16 along the vertical direction 12*c*. The tabs 54 may define threaded openings 56. Fasteners 58 may be inserted through the openings 28 defined by the handguard and engage the openings 56 in order to secure the endcap 42. In some embodiments, the rail cap portion 46 defines an opening 60 that is aligned with the opening 30 in the rail 16 when the endcap 42 is installed. A pin 62 or fastener may be inserted within the openings 30, 60 to facilitate alignment between these components during use.

In some embodiments, the rail cap 46 includes a sloped portion 64 relative to the front face 48 of the ring portion 44, e.g. slope rearwardly with distance from the ring portion 44. This sloped portion may extend up to a transition region located vertically aligned with the pointed side portions of the rail cap 46, at which point the front face 64 transitions to another sloped portion 66 that is sloped rearwardly a greater extent than portion 64. Region 66 extends from the transition region to the top (e.g., distal end) of the rail cap 46. Note that the front face 48 of the ring portion 44 may also be rounded or beveled around its inner and outer edges to avoid sharp edges.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus comprising:

a handguard comprising a tube centered on a central axis and a rail protruding outwardly from the tube and extending along the tube parallel to the central axis; and an endcap secured to a face of the tube and including a ring portion extending around a face of the tube and a rail cap extending outwardly from the ring portion and covering a face of the rail.

2. The apparatus of claim 1, wherein:

the handguard further comprises a plurality of splines protruding inwardly within the tube and extending parallel to the central axis; and the endcap comprises one or more tabs, each tab of the one or more tabs positioned between a pair of adjacent splines of the plurality of splines.

3. The apparatus of claim 2, wherein the tube includes a plurality of facets conforming to an octagonal shape, each spline of the plurality of splines being positioned at a junction of a pair of adjacent facets of the plurality of facets.

4. The apparatus of claim 2, further comprising one or more fasteners, each fastener of the one or more fasteners extending through the tube and engaging one tab of the one or more tabs.

5. The apparatus of claim 1, wherein the face of the tube is at a non-perpendicular angle with respect to the central axis, the ring portion increasing in thickness with distance from the rail cap.

6. The apparatus of claim 5, wherein the ring portion has a front ring face and a rear ring face opposite the front ring face, the rear ring face interfacing with the face of the tube and the front ring face being perpendicular to the central axis.

7. The apparatus of claim 6, wherein the rail cap has a front cap face and a rear cap face, the rear cap face interfacing with the face of the rail and the front cap face sloping toward the rail with distance from the ring portion.

8. The apparatus of claim 7, wherein the rail has pointed sides and the rail cap has corresponding pointed sides, the front cap face extending from the ring portion to the pointed sides of the rail cap, the rail cap including a second cap face extending from the front cap face and sloping toward the rail with distance from the front cap face at a greater angle than the front cap face.

9. The apparatus of claim 1, further comprising a rifle including an upper receiver and a barrel secured to the upper receiver, the tube being mounted to the upper receiver having the barrel positioned within the tube.

10. The apparatus of claim 9, wherein the barrel does not contact the tube.

11. The apparatus of claim 1, wherein inner and outer surfaces of the ring portion are flush with inner and outer surfaces of the tube extending parallel to the central axis.

12. The apparatus of claim 1, wherein the tube is made of extruded metal.

13. The apparatus of claim 1, further comprising a plurality of vent openings defined by the tube and distribute along the central axis.

* * * * *